United States Patent [19]

Jenewein

[11] 3,992,171

[45] Nov. 16, 1976

[54] REFRIGERATOR FREEZER FORCED AIR SYSTEM

[75] Inventor: Norman Jenewein, Cedar Rapids, Iowa

[73] Assignee: Amana Refrigeration, Inc., Amana, Iowa

[22] Filed: Nov. 10, 1975

[21] Appl. No.: 630,445

[52] U.S. Cl. ..... 62/419; 62/441

[51] Int. Cl.[2] ..... F25D 17/06; F25D 13/02

[58] Field of Search ..... 62/414, 408, 419

[56] References Cited

UNITED STATES PATENTS

| | | | |
|---|---|---|---|
| 2,794,325 | 6/1957 | Shearer | 62/89.5 |
| 3,364,696 | 1/1968 | Maxwell | 62/414 |
| 3,370,439 | 2/1968 | Rivard et al. | 62/419 |
| 3,375,679 | 4/1968 | Helsel | 62/441 |
| 3,382,683 | 5/1968 | Wiljamen | 62/419 |
| 3,630,046 | 12/1971 | Boor | 62/408 |
| 3,745,786 | 7/1973 | Laughlin et al. | 62/419 |
| 3,793,847 | 2/1974 | Scarlett et al. | 62/190 |
| 3,893,307 | 7/1975 | Jacobs | 62/150 |

*Primary Examiner*—Lloyd L. King
*Attorney, Agent, or Firm*—Steven R. Gustafson

[57] ABSTRACT

A forced air refrigeration system for a side by side combination refrigerator freezer wherein a single, vertical evaporator is enclosed in a vertical passageway formed between a cover panel and the rear wall of the freezer compartment. The large opening in the cover panel near the midsection of the evaporator provides an inlet from the freezer compartment into the passageway. A fan, mounted on the panel in front of the inlet opening, moves air from the freezer compartment through the opening into the middle of the evaporator. Air moved by the fan splits into two components, one moving upwardly through the top half of the evaporator and one moving downwardly through the lower half of the evaporator. After being cooled by the evaporator, the two air components exit at respective outlets formed at the upper and lower ends of the passageway. Circulation of air from the freezer compartment through the refrigerator compartment is accomplished by means of thermally controlled air ducts.

10 Claims, 3 Drawing Figures

REFRIGERATOR FREEZER FORCED AIR SYSTEM

BACKGROUND OF THE INVENTION

The combination freezer-refrigerators in which the refrigerator and freezer compartments have adjacent, vertical access doors are known generally as side by side refrigerator-freezers. The styling and convenience of side by side compartments has made the product very popular with consumers. In most side by sides, the cooling is accomplished by means of a single evaporator located in the freezer compartment. Air is forced over the evaporator and circulated by means of ducts into the freezer compartment and the refrigerator compartment.

Because of the height of each of the compartments, the side by sides have unique cooling properties and particular care must be taken to prevent temperature variations within each compartment. In response to this, various kinds and arrangements of evaporators, ducts, air dampers, defrost circuits and the like have been tested and used by different appliance manufacturers. But many have proven to be unreliable, and others consume considerable energy in accomplishing their cooling function.

It is an object of this invention to provide improved refrigerating apparatus comprising side by side frozen food and fresh food compartments. In particular, its objective is to provide more uniform temperatures in both the freezer compartment and the freezer door. Another major objective is the provision of a cooling system which conserves power and increases the operating efficiency by optimizing air flow and minimizing the resistance to air flow. An additional feature of the invention is a reduction in the noise level usually associated with operation of such refrigerator-freezers.

SUMMARY OF THE INVENTION

In accordance with the present invention there is provided a novel cooling system for a side by side refrigerator which yields more uniform temperatures within the cabinet yet consumes substantially less electrical energy than prior side by side refrigerators. Briefly, this is accomplished by a side-by-side type of freezer-refrigerator having vertically disposed freezer and refrigerator compartments separated by a vertical partition wall. A single, fin coil evaporator which cools both compartments is vertically disposed adjacent the lower portion of the rear wall of the freezer compartment behind a panel which terminates above the floor of the freezer compartment to form a lower air outlet and short of the roof the freezer compartment to provide an upper air outlet. A suitable fan is mounted in front of the midsection of the evaporator and is covered by a perforated shroud that provides an air inlet to the evaporator from the freezer compartment. The fan draws air in through the perforated shroud and directs it into the midsection of the evaporator. The air flow over the evaporator is split into two portions, one flowing upwardly, one downwardly. The upwardly directed air passes behind the evaporator cover panel and is discharged at the top of the compartment. As it is recirculated back to the fan it flows downwardly through the upper food storage shelves and sweeps past the food stored on the shelves in the door. The air flowing downwardly over the evaporator is discharged from behind the panel at the bottom of the compartment. From there it circulates upwardly back to the fan.

When cooling of the refrigerator compartment is needed, a portion of the upwardly moving air is directed through an upper lateral duct formed through the partition wall which carries some of the chilled air through a thermocontrolled damper assembly into the refrigerator compartment, whence it flows downwardly and is returned to the evaporator by another lateral duct through the partition wall rearward of the fan shroud. A suitable thermostatic control governs operation of the refrigerant system.

The splitting of the air into two components as it passes through the evaporator and the freezer compartment reduces the frictional air loss and increases the average temperature difference between the cooling air and the evaporator. This split air concept coupled with the back to front air flow has been found to reduce the electrical energy consumption of the side by side refrigerator by a significant amount as compared with prior side by sides of the same size. In addition, the sound level associated with such refrigerators has been reduced appreciably.

The details and features of the invention will be more readily apparent from the following description of one embodiment of the invention, considered in conjuncture with the accompanying drawings.

DESCRIPTION OF THE PREFERRED EMBODIMENT

Figure 1:
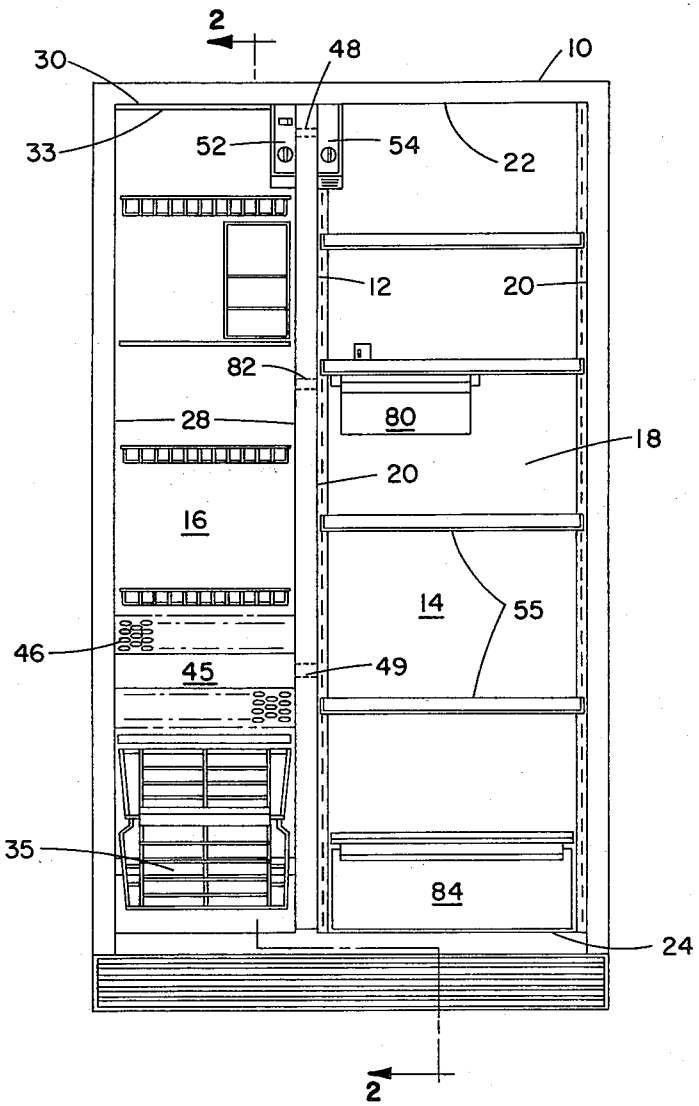
FIG. 1 is a front elevational view of a side-by-side refrigerator-freezer shown with the doors removed.

The freezer-refrigerator combination shown in FIG. 1 is one in which the refrigerator and freezer compartments are side-by-side. The cabinet, indicated generally by the reference numeral 10, has a central vertical partition 12 which separates the cabinet into an above-freezing temperature refrigerator compartment 14 and a below-freezing temperature frozen food or freezer compartment 16. The respective compartments are closed by separate insulated doors, such as door 13 shown in FIG. 2 closing compartment 16.

The cabinet 10 includes an outer cabinet wall 17 and a pair of inner liners spaced thereform by suitable insulation, as is well known to those skilled in the art, to form the refrigerator compartment 14, and the freezer compartment 16, respectively, and the partition 12. The refrigerator liner provides a back wall 18, side walls 20, a top wall 22 and a bottom wall 24. Similarly, the freezer liner provides a back wall 26, side walls 28, a top wall 30, and bottom wall 32.

Figure 2:
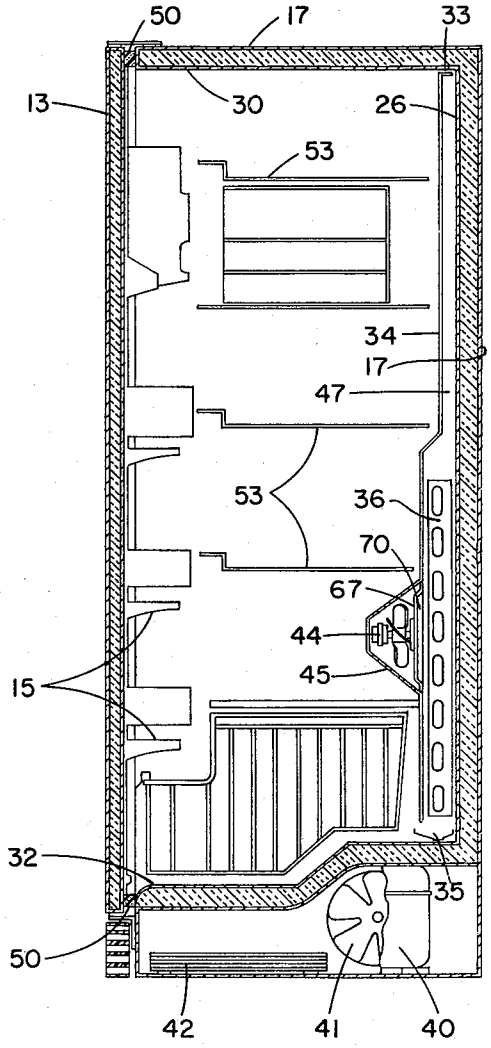
FIG. 2 is a vertical sectional view taken along the lines 2—2 of FIG. 1.

As best seen in FIG. 2, a vertical panel 34 is spaced forwardly of the back wall 26 of the freezer to provide a vertical passageway 47 in which an evaporator 36 is positioned. Evaporator 36 is of the fin and tube type and is disposed upright with its fins extending vertically. A sealed motor-compressor unit 40, a condenser fan 41 and a condenser 42 are located beneath the bottom wall 32 of the freezer compartment which is upwardly shaped at its rear to provide a space therefor. This refrigeration apparatus functions in a conventional manner to provide refrigerant fluid to the serpentine tube portion of the evaporator 36.

The refrigeration of the compartments is effected by the air passing from the compartments 14 and 16 between the cooled fins of evaporator 36. In this case the means for moving the air is a fan 44 located in front of the midsection of the evaporator 36, behind a perforated shroud or housing 45. Air is drawn inwardly through the perforations 46 in the shroud past the fan 44 and is discharged for passage over the evaporator 36. About one half of the air drawn in by the fan 44 is moved behind the panel 34 downwardly over the lower half of the evaporator 36 and exits through opening 35 at lower end of panel 34 for circulation into the lower portion of the freezer compartment. The other portion of the air is directed upwardly over the upper portion of the evaporator 36 and into a passageway 47 formed by the upper end of the vertical panel 34 and the backwall 26 of the freezer compartment. The cooled air is discharged into the upper portion of the freezer compartment through opening 33 at the upper end of the passageway 47.

Air discharged from the upper opening 33 moves downwardly through the shelves 53 to the fan 44 where it is drawn in and recirculated over the evaporator 36. In a similar manner the air which is discharged downwardly between the evaporator fins is moved upwardly back to the fan 44. This recirculation and cooling of the air continues until the temperature in the freezer section is lowered to the point set on the thermostatic control 52 at which time the refrigeration system will be shut off. The thermostatic control 52 is responsive to air coming off the evaporator 36. It is wired in series with the power supply line to the compressor 40 and to the fan motors 41 and 44. The circuit is closed or opened by the control 52 in conventional fashion.

The position of the evaporator 36 and fan 44 has particular utility in assuring uniform temperatures in the freezer section. Since the air is split into two components, one downward, one upward, the discharged air has a shorter path to travel before it returns to the evaporator. This feature is of most importance where air flow is restricted as when the freezer is full of food. In addition, since the evaporator 36 is at the back of the freezer compartment 16 the air emitted from the upper opening 33 and the lower opening 35 tends to sweep past the food stored on the door shelves 15. The food stored in the door 13 and at the front of the shelves 41 is most susceptible to heat gain because of its close proximity to the relatively thin door gaskets 50 and of course because of its exposure when the freezer door 13 is opened. As a result, the cooling of this area is of particular importance. The present invention with the dual direction air flow from the back wall accomplishes this cooling function effectively. Measurements under standard test conditions have shown substantial reduction in temperature variation within a freezer compartment 16 incorporating the present invention.

The splitting of the air over the evaporator 16 also reduces the system air flow resistance. The given volume of air needed for cooling is split in two. About one half the air is traversing only one half of the evaporator's fins and tubes. Because the volume is less, the velocity of the air is less; and since frictional air loss is proportional to the air velocity squared, a further reduction in system resistance is attained. Added to this is the efficiency improvement due to the greater temperature difference between the air and evaporator coil. This combination of items contributing to improved heat transfer and air distribution have allowed the size of the fan motor 44 to also be reduced. The fan motor 60 incorporated in the present invention requires 65% less energy for operation than prior models. Its reduction in wattage also has a cumulative effect. Since the motor 60 is located in the freezer section 16, a reduction in motor wattage lessens the amount of heat input to the cabinet and thus lessens the amount of heat that must be removed from the compartment by the refrigeration system. Furthermore, because of the location of the motor 60, the heat which is generated by the operation of the motor does not enter the cabinet. Instead, the air moving over the fan motor 60 goes directly into the cold evaporator 36. An auxiliary benefit is a reduction in noise level resulting from the smaller fan size.

The perforations in the shroud which covers the fan also help reduce the sound level generated by the moving air. In addition, they impede the air flow from the freezer section so that there is a slight suction applied to the refrigerator compartment air at the inlet hole 49 formed in the partition wall 12. In a similar manner the opening 33 at the upper end of the freezer cabinet 16 is arranged to restrict flow so that a slight pressure is applied at the outlet duct 48 which opens into the refrigerator compartment. This feature helps assure positive air flow and control of air circulated through the refrigerator compartment. The circulation path for air through the refrigerator compartment 14 includes the horizontal molded inlet duct 48 disposed in the partition 12 which connects the upper end of the passageway 47 with the refrigerator compartment 14. The inlet duct 48 opens into the refrigerator compartment 14 through a thermostatically controlled damper 54 which regulates the size of the discharge opening into the refrigerator compartment 14. A thermostat within the control 54 is responsive to the air temperature in the refrigerator compartment and controls operation of the damper 54. The warm air returning to the evaporator 36 from the refrigerator compartment 14 passes through a lower duct 49 formed in the partition 12 at a point behind the fan shroud 45. Return air from the freezer compartment 16 is circulated back to the evaporator 36 through the perforated opening in the fan shroud 45. Thus, the return air from both compartments 14 and 16 conjoin for passage up through the evaporator 36.

The main inlet opening 68 has a large diameter approximating that of the fan blades. Thus, the fan discharges into the large side surface of the evaporator 36 rather than into the relatively narrow end section as is typically found in the prior art.

The evaporator coil 36 has about the same total surface area, as prior vertical coils used in similar side-by-side refrigerator-freezers. However, whereas prior evaporators typically stagger the fins at the inlet end of the coil to compensate for expected frost build up, the present invention is able to have uniformly spaced fins. This uniform fin spacing contributes to easier fabrication of the evaporator.

The refrigerator compartment is equipped with suitable shelving 55, a high humidity or crisper compartment 84, and a meat keeper compartment 80. The meat keeper 80 has a structure similar to that disclosed in the U.S. Pat. No. 3,473,345 to A. J. Pfeiffer and L. R. Marz. It is in the form of a drawer slidably fitted within an open front sleeve so that an air circulating passageway is defined between the walls of the drawer and the sleeve. Air from the freezer compartment is directed into the passageway by means of an air inlet port 82 formed in the vertical partition wall.

Figure 3:
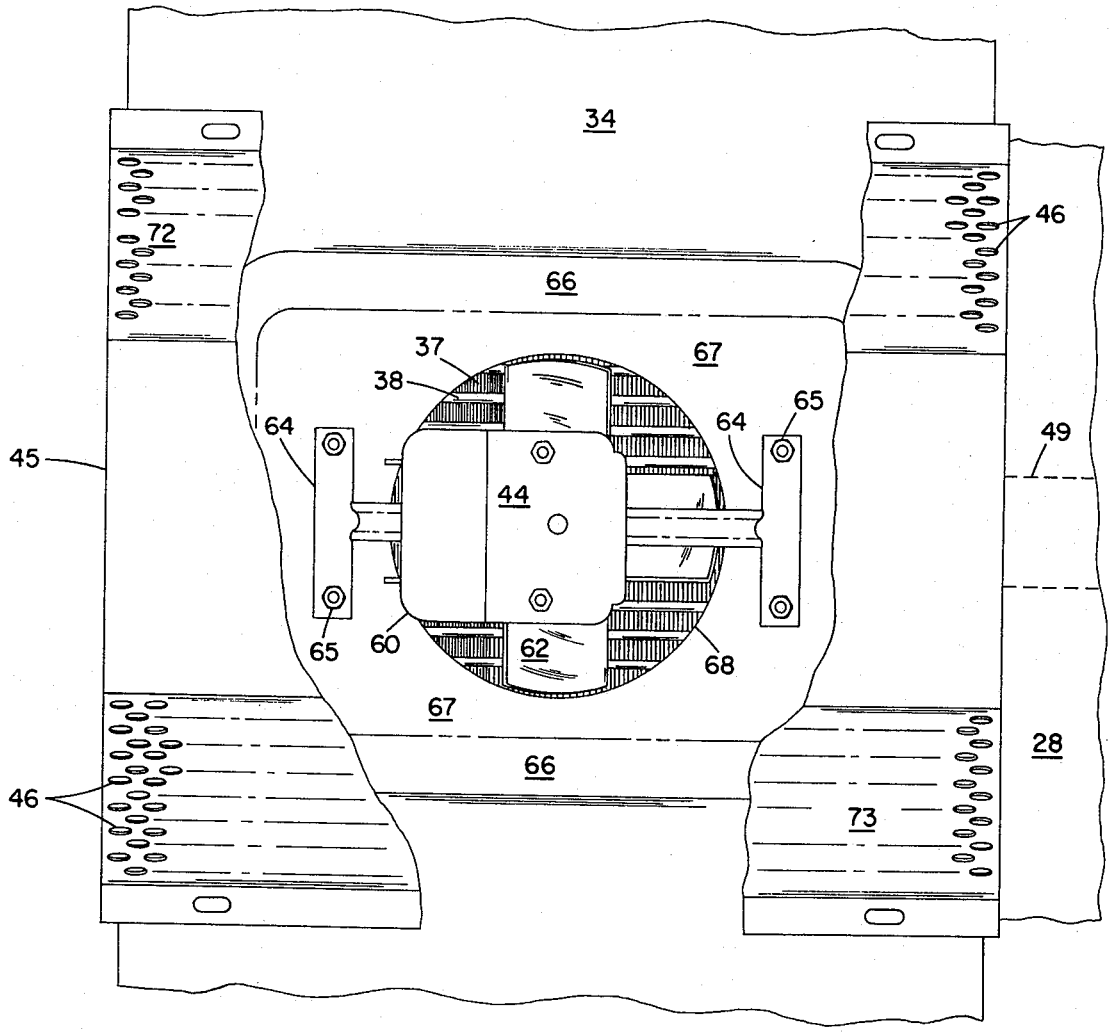
FIG. 3 is an enlarged front elevational view of the fan shroud with portions of the fan shroud broken away to show details of the fan assembly.

The enlarged front elevational view of FIG. 3 illustrates the details of the fan 44 and shroud 45. Portions of the shroud are broken away to illustrate the fan mounting. In the region of the fan 44, the evaporator cover panel 34 is bent away from the evaporator 36 forming inclines 66 that culminate in a flat landing or platform 67 on which the fan 44 is mounted. As is best seen in FIG. 2 the raised platform 67 provides an added space 70 between the evaporator cover panel 34 and the evaporator 36. Provided in the center of the platform 67 is a large opening 68 that permits the discharge of air from the fan 44 into the fins 37 and tubes 38 forming the evaporator 36. The fan 44 comprised of motor 60 and fan blade 62 is disposed over the opening 68 and mounted there by appropriate brackets 64 and fasteners 65.

The fan shroud 45 covers the entire arrangement of platform 67 and fan 44. As shown in FIG. 2, the cross-section of the shroud 45 has a trapezoidal shape thus forming a frustum-pyramidal-type body. The opposite, non-parallel sides 72 and 73 of the trapezoid have a selected number of relatively small openings 46 formed therein. The multiplicity of openings 46 perform the functions of reducing the noise level associated with moving air, slightly impeding the air flow from the freezer compartment 16 so that a slight suction is applied at the duct 49 which returns air from the refrigerator compartment 14, and improving heat transfer between the air and the evaporator by promoting turbulent air flow.

It will be apparent to those skilled in the art that while the embodiment of the present invention constitutes a preferred form, many modifications and revisions can be made without departing from the scope of the invention. It is intended, therefore, that such revisions and modifications be included within the scope of the following claims.

I claim:

1. A side by side combination refrigerator-freezer having an insulated cabinet defining a refrigerator compartment and an adjacent freezer compartment separated by an insulated partition wall, comprising:

a refrigeration system including a single vertically disposed evaporator of the finned coil type to cool air circulated therethrough;

a forced air circulation system having a vertically disposed, air passageway which includes a back wall of the freezer compartment, the vertically disposed evaporator being positioned within the air passageway so that air may pass between the fins of the evaporator;

means forming an upper air outlet adjacent the upper end of the air passageway and means forming a lower air outlet adjacent the lower end of the passageway;

means providing a main opening from the freezer compartment into the air passageway adjacent the midsection of the evaporator;

means disposed adjacent the main opening for moving air through the midsection opening into the passageway such that a portion of the moving air may be moved upwardly across the upper portion of the evaporator and exit out the upper opening into the freezer compartment and another portion of the air may be moved downwardly across the lower portion of the evaporator and exit out the lower opening into the freezer compartment;

a laterally extending air supply duct providing for air flow from the passageway into the refrigerator compartment; and a laterally extending air return duct providing for air flow from the refrigerator compartment into the freezer compartment.

2. A side by side combination refrigerator-freezer having a cabinet defining a refrigerator compartment and an adjacent freezer compartment separated by a partition wall, comprising:

a refrigeration system including a single, unitary upright evaporator;

an upright evaporator chamber and passageway associated with the freezer compartment rear wall containing the evaporator;

blower means having an outlet connected to the evaporator chamber in front of the approximate midsection of the evaporator, and having an inlet in communication with the freezer compartment;

upper and lower freezer compartment air outlets for conveying air from the passageway, the upper outlet disposed at a point above the fan and the lower outlet disposed at a point below the fan;

a cold air supply duct extending from the freezer compartment to the refrigerator compartment for discharging part of the cold freezer compartment air into the refrigerator compartment;

an air return duct disposed at a location substantially away from the supply duct and extending from the refrigerator compartment to the freezer compartment and;

damper means for controlling the flow of air between the freezer compartment and the refrigerator compartment.

3. A side by side combination refrigerator-freezer having a cabinet defining a refrigerator compartment and an adjacent freezer compartment separated by a partition wall, comprising;

means providing a vertically disposed, air passageway along a back wall of the freezer compartment, the upper and lower ends of the air passageway provided with openings communicating with the freezer compartment;

a refrigeration system including a single vertically disposed evaporator positioned within the air passageway;

means providing a main opening between the freezer compartment and the air passageway adjacent the midsection of the evaporator;

means disposed in front of and adjacent the main opening for moving air through the main midsection opening in the passageway and the upper and lower openings such that a portion of the moving air may be moved across the upper portion of the evaporator and another portion of the air may be moved across the lower portion of the evaporator;

a laterally extending air supply duct providing for air flow from the freezer compartment into the refrigerator compartment;

a laterally extending air return duct providing for air flow from the refrigerator compartment into the freezer compartment; and means for controlling the flow of air through the refrigerator compartment by way of the ducts.

4. A forced air refrigeration system for a side by side combination refrigerator-freezer having an insulated cabinet defining a refrigerator compartment and an adjacent freezer compartment separated by an insulated partition wall, comprising;

means forming a vertical passageway extending along the back wall of the freezer compartment, the passageway having an inlet opening and an upper and lower outlet opening, a single, upright evaporator within the insulated cabinet and positioned in the passageway;

the inlet opening into the passageway disposed in front of the approximate midsection of the evaporator, the upper outlet disposed at a point substantially above the inlet opening and the lower outlet disposed at a point substantially below the inlet;

a fan mounted adjacent the passageway inlet for moving air through the inlet such that one portion of air is moved upwardly over and through the upper portion of the evaporator for discharge out the upper outlet and another portion of air is moved downwardly over and through the lower portion of the evaporator for discharge out the lower outlet;

a shroud covering the fan, the shroud having a plurality of openings formed therein permitting flow of air from the freezer compartment to the fan;

an air supply duct extending laterally from an upper portion of the passageway through the insulated partition wall and opening into the refrigerator compartment;

an air return duct disposed at a position below the supply duct and extending laterally from the refrigerator compartment into the freezer compartment at a point behind the fan shroud;

a thermostatically controlled damper means responsive to predetermined temperature levels in the cabinet for controlling the flow of air through the supply duct into the freezer compartment; and thermostatic control means responsive to predetermined temperature levels for establishing and maintaining cyclic operation of the refrigeration system including the evaporator.

5. A refrigeration system according to claim 4 wherein the cross section of the fan shroud is trapezoidal in shape and the plurality of openings are formed in the opposite, non-parallel sides of the shroud.

6. A refrigeration system according to claim 4 wherein the means forming the vertical passageway includes the back wall of the freezer compartment and a vertical panel substantially parallel to the back wall, the panel being spaced a sufficient distance from the back wall to provide for inclusion of the evaporator in the passageway.

7. A refrigeration system according to claim 6 wherein the inlet comprises an opening formed in the vertical panel and the area of the panel adjacent the opening is raised such that it is spaced a greater distance from the evaporator than is the remainder of the panel, the raised portion of the panel providing a platform on which the fan is mounted.

8. A refrigeration system according to claim 4 wherein the evaporator is positioned adjacent the lower end of the passageway.

9. A refrigeration system according to claim 8 wherein the air supply duct is positioned adjacent the top of the cabinet and the return duct is positioned a substantial distance below the supply duct such that the return duct is closer to the bottom wall of the cabinet than it is to the supply duct.

10. A refrigeration system according to claim 9 wherein the upper outlet opening from the passageway is sufficiently small to restrict flow therefrom and promote flow through the air supply duct.

* * * * *